US010450820B2

(12) United States Patent
Hart et al.

(10) Patent No.: US 10,450,820 B2
(45) Date of Patent: Oct. 22, 2019

(54) METHOD AND APPARATUS FOR SWARF DISPOSAL IN WELLBORES

(71) Applicants: Daniel R. Hart, Sugar Land, TX (US); Andrew D. Ponder, Houston, TX (US); Lambertus C. Joppe, Tomball, TX (US)

(72) Inventors: Daniel R. Hart, Sugar Land, TX (US); Andrew D. Ponder, Houston, TX (US); Lambertus C. Joppe, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 188 days.

(21) Appl. No.: 15/471,544

(22) Filed: Mar. 28, 2017

(65) Prior Publication Data

US 2018/0283120 A1 Oct. 4, 2018

(51) Int. Cl.

| | |
|---|---|
| ***E21B 17/22*** | (2006.01) |
| ***E21B 29/00*** | (2006.01) |
| ***E21B 21/00*** | (2006.01) |

(52) U.S. Cl.
CPC ..... *E21B 29/005* (2013.01); *E21B 21/00* (2013.01)

(58) Field of Classification Search
CPC ..... E21B 29/002; E21B 29/005; E21B 17/22
See application file for complete search history.

(56) References Cited

U.S. PATENT DOCUMENTS

2014/0262525 A1* 9/2014 Fuller ..... E21B 10/322 175/57
2015/0013997 A1* 1/2015 Simpson ..... E21B 17/1064 166/382
2018/0128071 A1* 5/2018 Clem ..... E21B 29/005

* cited by examiner

*Primary Examiner* — Catherine Loikith
(74) *Attorney, Agent, or Firm* — Cantor Colburn LLP

(57) ABSTRACT

A milling apparatus for cutting a tubular in a wellbore includes a cutting element on a tool body configured to cut the tubular in a wellbore when the cutting element is activated when the tool is moving upward inside the tubular. The cutting element cuts the tubular to form cuttings that fall into an annulus between the tubular and the wellbore. An agitator below the cutting element agitates the cuttings in the annulus to aid the cuttings to move from the annulus into the wellbore below the milling apparatus.

21 Claims, 2 Drawing Sheets

METHOD AND APPARATUS FOR SWARF DISPOSAL IN WELLBORES

BACKGROUND

1. Field of the Disclosure

The disclosure herein relates generally to mills for milling casings in a wellbore and specifically to mills that include an apparatus that may be used to break-up the cuttings (swarf) created by the mills during upward milling of the casings.

2. Background of the Art

Wellbores are drilled in subsurface formations to produce hydrocarbons (oil and gas). Modern wells can extend to great well depths, often more than 15,000 ft. A wellbore is typically lined with casing (a string of metal tubulars connected in series) along the length of the wellbore to prevent collapse of the formation (rocks) into the wellbore. A variety of devices are installed in the wellbore to produce the hydrocarbons from the formation surrounding the wellbore from one or more production zones. Sometimes it is necessary to mill a section of the casing to perform a downhole operation, such as forming windows for forming lateral wellbores, abandoning wells, etc. To perform a milling operation, a tool (commonly referred to as a mill), with cutting members (also referred to as knives or blades) is typically conveyed inside the casing by a tubular. In one type of mills, the mill is activated and pulled upward (uphole) to cut the casing into cuttings (also referred to as "swarf"). The cuttings are often in the form of strings and tend to accumulated in the space between the mill and the wellbore.

The disclosure herein provides mills that include an apparatus attached below the cutters of the mill that breaks-off the cuttings and aids such cuttings to fall into the wellbore below the mill as the mill is pulled uphole.

SUMMARY

In one aspect, a milling apparatus for cutting a tubular in a wellbore is disclosed that in one non-limiting embodiment includes a cutting element on a tool body configured to cut the tubular in a wellbore when the cutting element is activated when the tool is moving upward inside the tubular. The cutting element cuts the tubular to form cuttings that that fall into an annulus between the tubular and the wellbore. An agitator below the cutting element agitates the cuttings in the annulus to aid the cuttings to fall from the annulus into the wellbore below the milling apparatus.

In another aspect, a method of milling a tubular in a wellbore is disclosed that in one non-limiting embodiment includes: positioning a milling device at a start location in the wellbore, wherein the milling device includes: a cutting element on a tool body configured to cut the tubular in the wellbore when the cutting element is activated and moved upward inside the tubular, wherein the cutting element cuts the tubular into cuttings that are disposed in an annular space between the tool body and a wellbore wall; activating the cutting element to contact the tubular; cutting the tubular by moving the cutting element from the start location to an end location; and causing the agitator to aid the cuttings to move from the annular space into the wellbore.

Examples of the more important features of an apparatus and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWING

For a detailed understanding of the apparatus and methods disclosed herein, reference should be made to the accompanying drawing and the detailed description thereof, wherein like elements are generally given same numerals and wherein.

DETAILED DESCRIPTION

Figure 1:
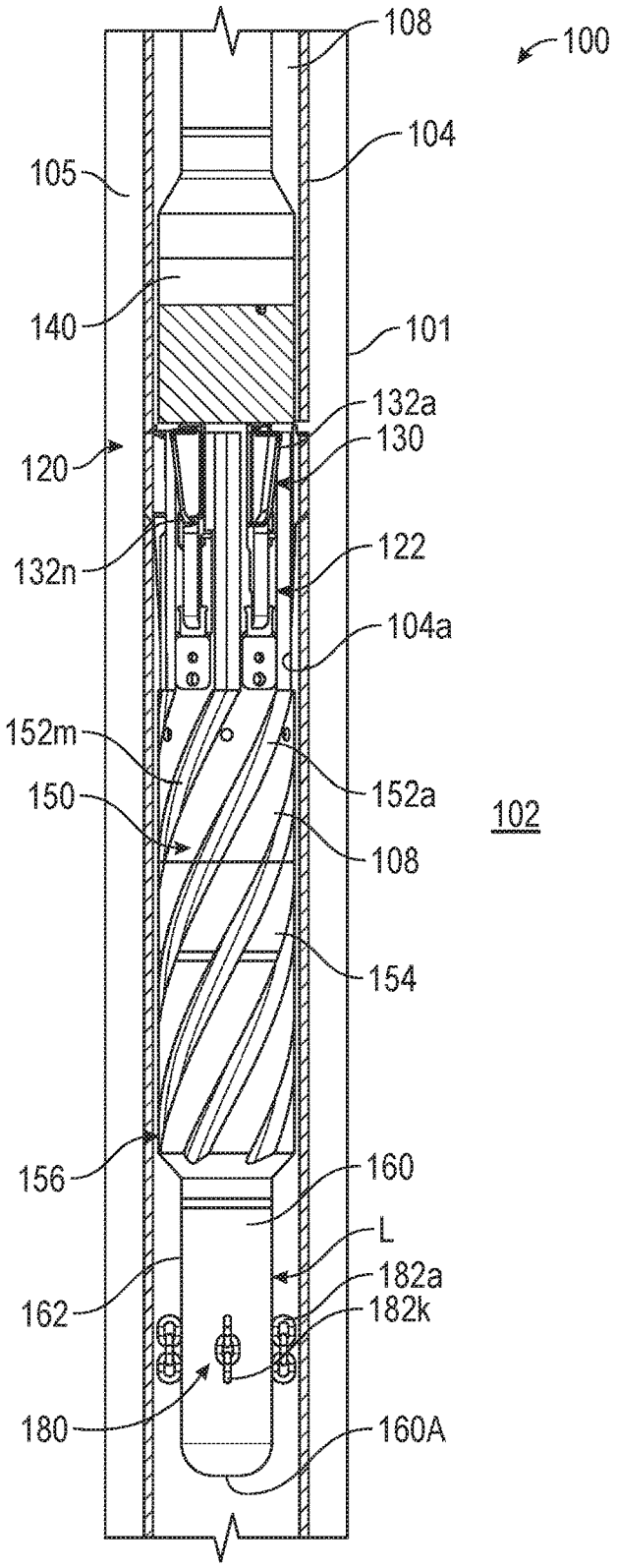
FIG. 1 shows a mill that includes an agitator according to a non-limiting embodiment of the disclosure in a run-in position placed at a staring location inside the casing in a wellbore.

FIG. 1 shows a wellbore system 100 that includes a well or wellbore 101 formed in a formation 102. The well 101 is shown lined with a tubular referred to as casing 104. The space 105 (also referred to herein as the annulus) between the well 101 and the casing 104 is shown filled with cement 106. It is often desired to mill a portion of the casing 104, for example to provide windows for drilling lateral wellbores from the wellbore 101. A variety of tools, generally referred to as mills or milling tools are used to mill desired sections of the casings to form windows. A mill or milling tool 120 (also referred to herein as the cutting apparatus), formed according a non-limiting embodiment of the disclosure, is shown run-in or placed inside the casing 104 at a desired or suitable location 104*a* that designates the starting point of the milling operation, for example to form a window. The mill 120 includes a body 122 that carries a cutting device or milling device 130 that includes several cutters (or blades) 132*a*-132*n* disposed around the body 122. In one embodiment, the cutters 132*a*-132*n* are disposed around the body 122, wherein each such cutter is radially extendable from the body 122 and retractable to its original position on the body 122. A power unit 140 in the mill 120 provides power to radially extend the blades 132*a*-132*n* from the body 122. The power unit 140 may be any suitable device, including, but not limited to, a hydraulic device and an electric device, such as an electric motor. In one aspect, the mill is configured to mill the casing 104 while the mill 120 is being pulled upward or up hole.

Still referring to FIG. 1, the mill 120, in one embodiment, may further include a channel section or channel device 150 below the cutters 132*a*-132*n* that includes one or more slots or channels 152*a*-152*m* formed on an outer surface 154 of the channel device 150 to facilitate moving of the cuttings or swarf produced by the cutting device 130 to a location below the mill 120. The channel device 150 rotates as the cutters 132*a*-132*n* rotate. The slots 152*a*-152*m*may be of any shape and size sufficient to move the cuttings therethrough. Such slots may be helical, as shown in FIG. 1, or of any other suitable configuration formed axially so that they are in communication with fluid 108 inside the casing 104. The milling device 120 further includes a nose 160 having a bottom end 160*a* and length "L" below the channel device 150. The nose 160 rotates as the cutters 132*a*-132*n* rotate. In one embodiment, the outside dimension or diameter 162 of the nose 160 is less than the outer dimension or diameter 156 of the channel section 150. In one non-limiting embodiment, the milling device 120 further includes an agitator 180 below the cutting device 130. In one embodiment, the agitator 180 may be placed around the nose 160. In one embodiment, the agitator 180 may include a number of extendable elements or members, such as chains 182*a*-182*k*, that rotate as the nose 160 rotates. Although the mill 120 is shown to include both the channel device 150 and the agitator 180, the mill may be configured without the channel section, with the agitator 4-60 180 disposed below the cutters 132*a*-132*n*.

Figure 2:
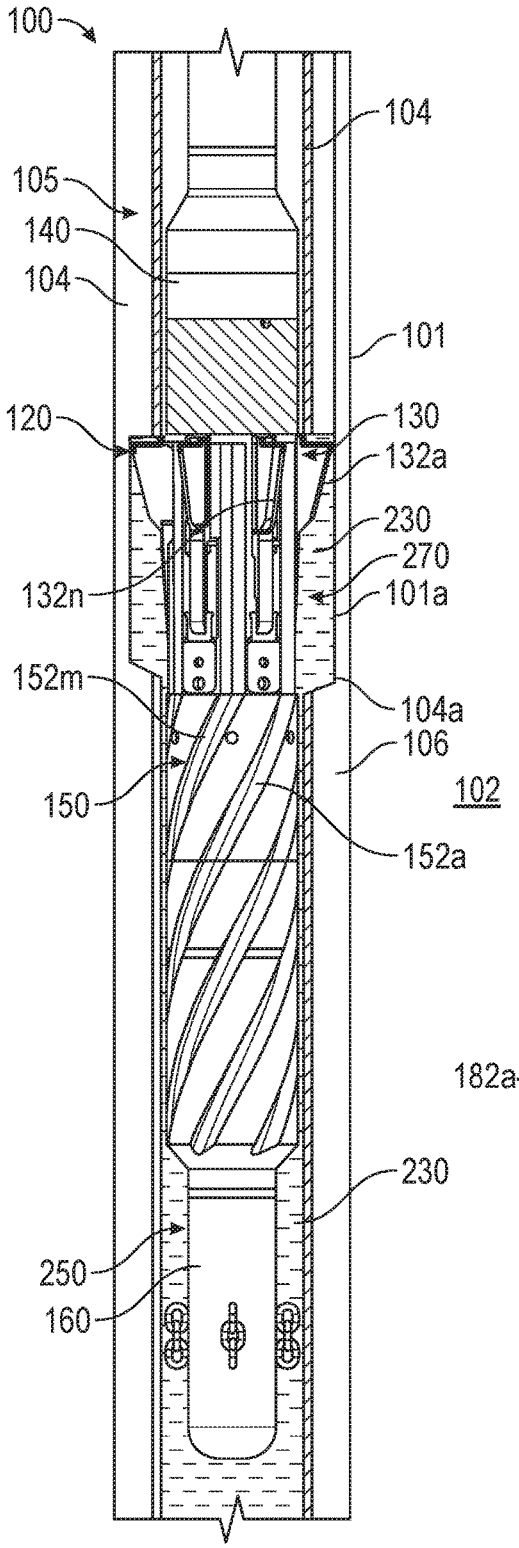
FIG. 2 shows the mill of FIG. 1 in the milling position while the mill is being pulled uphole, wherein the agitator is not yet active.

FIG. 2 shows the milling device 120 of FIG. 1 that has been activated to initiate milling of the casing 104. To mill a section of the casing 104, the milling device 120 is activated to cause the cutters 132*a*-132*n* to rotate and extend radially outward to contact the casing 104. The power unit 140 may be any suitable device, including but not limited to a hydraulic unit, such as a motor operated by flowing a fluid under pressure therethrough or an electric motor. The milling device 120 is pulled upward toward the surface to mill the casing at a selected or desired rate. The cutters 132*a*-132*n* disintegrate the casing 104 into cuttings or swarf 230. In FIG. 2, the milling device 120 is shown to have milled a portion of the casing 104 starting from the initial location 104*a*. The milling device 120 is pulled upward at a selected rate while the cutters 132*a*-132*n* are activated to continuously mill the casing 104. The size of the cuttings 230 is a function of the cutter design and the rotational speed of the cutters. The cutters produce cuttings 230 of different size that can include strings. As shown in FIG. 2, during the initial process of cutting the casing 104, the cuttings 230 accumulate into an area or annulus 270 between the milling device 120 and inside 101*a* of the wellbore 101. Since the channel device 150 is rotating while the cutters 132*a*-132*n* are cutting the casing 104 and the milling device 120 is moving upward, the cuttings 230 tend to flow downward into the wellbore via the fluid filled channels 152*a*-152*m*. Thus, the channels 152*a*-152*m* aid or facilitate moving of the cuttings 230 from the annulus 270 down to area or annulus 250 between the nose 160 and the casing 104 below the channel device 150. The cuttings 230 then flow from the annulus 250 into the wellbore inside below the milling device 120.

Figure 3:
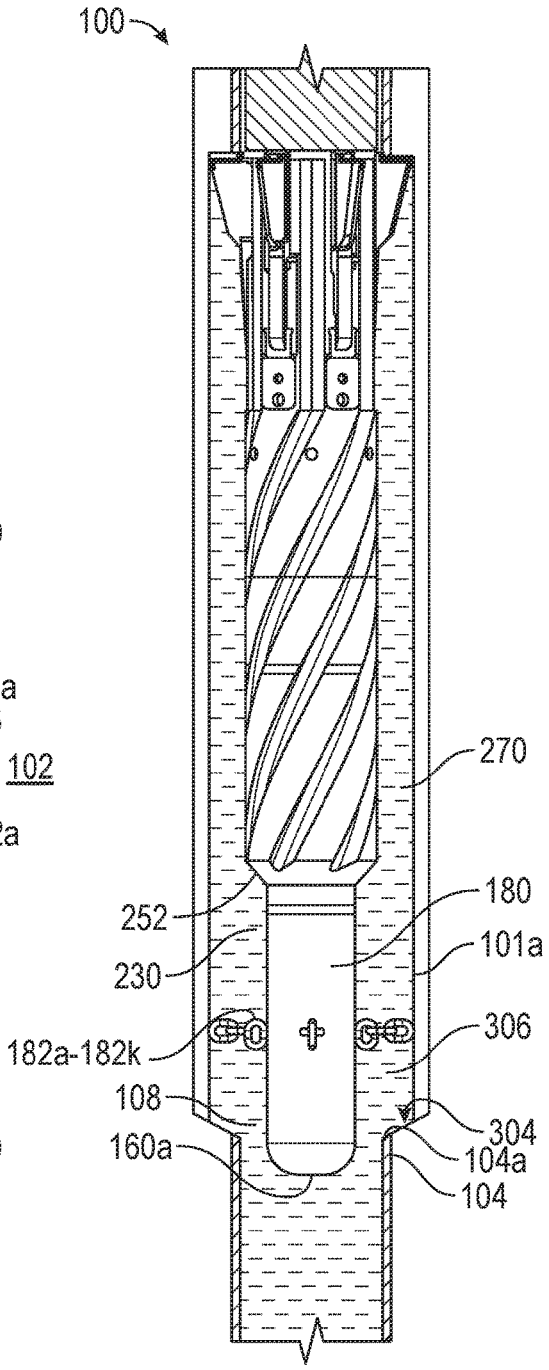
FIG. 3 shows the mill of FIG. 2 when the mill has milled a certain length of the casing and the agitator is active.

Referring now to FIG. 3, once a certain length of the casing 104 has been milled, the bottom end 252 of the channel device comes above the start location 104*a* of the casing 104. As the milling continues and the milling device 120 is pulled upward, the agitator 180 moves above the start location 104*a* and the agitator elements 182*a*-182*k* start to rotate as nose 160 is rotating. The agitator elements 182*a*-182*k* agitate the cuttings 230 falling into the area 270 and prevent such cuttings from accumulating in the area 304 at the intersection of the start location 104*a* and the enlarged diameter 306 of the area 304 above the casing 104 at location 104*a*. The agitator also can break up the strings of the cuttings into smaller pieces, which can facilitate moving such cuttings through the channel device 150. During the milling process described above, the annulus 270 between the mill 120 and the wellbore inside 101*a* remains filled with the wellbore fluid 108. The agitator elements 182*a*-182*k* continuously agitate or stir the cuttings 230 in the fluid 108, which causes the cuttings 230 to remain in the fluid and cause such cuttings to fall or flow into the wellbore below the nose end 160*a*, thus preventing accumulation of such cuttings in the annulus 270 above the bottom end 304 of the annulus 270 along the wellbore inside wall 101*a*.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A milling apparatus for cutting a tubular in a wellbore, comprising:

a cutting element on a tool body configured to cut the tubular in the wellbore when the cutting element is activated and moving upward inside the tubular, wherein the cutting element cuts the tubular to form cuttings;

a power unit for activating the cutting element from a retracted position to an expanded position to cause the cutting element to contact the tubular to cut the tubular into the cuttings, wherein the cuttings fall into an annulus between the tubular and the wellbore and;

an agitator below the cutting element that agitates the cuttings in the annulus to aid cuttings to fall from the annulus into the wellbore below the milling apparatus, the agitator including an extension member that extends beyond an inner diameter of the tubular.

2. The milling apparatus of claim 1, wherein the extension member rotates to contact the cuttings to guide the cuttings into the wellbore.

3. The apparatus of claim 2, wherein the extension member is selected from a group consisting of: a chain having a length that extends beyond the inside diameter of the tubular; and a flexible mechanical member that extends beyond the inside diameter of the tubular.

4. The milling apparatus of claim 2, wherein the extension member rotates as the cutting element rotates.

5. The milling apparatus of claim 2, wherein extension element is attached to a reduced diameter section at a bottom end of the body that rotates as the cutting element rotates.

6. The milling apparatus of claim 1, wherein the power unit for activating the cutting element is selected from a group consisting of: a hydraulic unit; an electric motor; an electro-mechanical device; and a hydro-mechanical device.

7. The milling apparatus of claim 1, further comprising a channel device below the cutting element that directs the cuttings from the annulus to a location below the channel device.

8. The milling apparatus of claim 7, wherein the channel device includes a channel along a surface thereof that is in communication with cuttings in the annulus and enables the cuttings to flow through the channel to the location below the channel device.

9. The milling device of claim 1, wherein the milling device is configured to be connected to a drill pipe coupled to a rotary device at a surface location and wherein rotating the drill pipe at the surface rotates the milling device.

10. A method of milling a tubular in a wellbore, comprising:

positioning a milling device at a start location in the wellbore, wherein the milling device includes: a cutting element on a tool body configured to cut the tubular in the wellbore when the cutting element is activated and moved upward inside the tubular, wherein the cutting element cuts the tubular into cuttings that are disposed in an annular space between the tool body and a wellbore wall;

activating the cutting element to contact the tubular;

cutting the tubular by moving the cutting element from the start location to an end location; and rotating an agitator to extend an extension member beyond an inner diameter of the tubular in order aid the cuttings to move from the annular space into the wellbore.

11. The method of claim 10, wherein the extension member contacts the cuttings in the annular space to guide the cuttings into the wellbore.

12. The method of claim 11, wherein the extension member is selected from a group consisting of: a chain having a length that extends beyond the inside diameter of the tubular; and a flexible mechanical member that extends beyond the inside diameter of the tubular.

13. The method of claim 12, wherein activating the cutting element incudes utilizing a power unit to activate the cutting element that is selected from a group consisting of: a hydraulic unit; an electric motor; an electro-mechanical device; and a hydro-mechanical device.

14. The method milling apparatus of claim 13, wherein the extension member rotates as the cutting element rotates.

15. The method of claim 13, wherein the extension element is attached to a reduced diameter section at a bottom end of the body that rotates as the cutting element rotates.

16. A milling apparatus for cutting a tubular in a wellbore, comprising:

a cutting element configured to cut the tubular in the wellbore when the cutting element is activated and moving upward inside the tubular, wherein the cutting element cuts the tubular to form cuttings;

a power unit for activating the cutting element from a retracted position to an expanded position to cause the cutting element to contact the tubular to cut the tubular into the cuttings;

at least one channel around an outer surface of a body of the milling apparatus below the cutting element to guide the cuttings to fall into the wellbore; and an agitator rotatable to extend an extension member beyond an inner diameter of the tubular to agitate the cuttings in the annulus to aid cuttings to fall from the annulus into the wellbore below the milling apparatus.

17. The milling apparatus of claim 16, wherein the cuttings are disposed in an annular space between the body of the milling apparatus and a wellbore wall.

18. The milling apparatus of claim 17, wherein the at least one channel causes the cuttings to move from the annular space inside the wellbore below the cutting element.

19. The milling apparatus of claim 16, wherein the at least one channel is selected from a group consisting of: one or more helical channels; and one or more cross-channels.

20. The milling apparatus of claim 16, wherein the power unit for activating the cutting element is selected from a group consisting of: a hydraulic unit; an electric motor; an electro-mechanical device; and a hydro-mechanical device.

21. The milling apparatus of claim 16, wherein the cutting element is disposed on a housing having a nose at a bottom end thereof and wherein the cuttings accumulate in an annular space formed between the housing and the wellbore inside when the nose is below the annular space.

* * * * *